United States Patent [19]

Budish

[11] 4,275,910

[45] Jun. 30, 1981

[54] DOOR LATCH

[76] Inventor: Joseph D. Budish, 1635 Madison Ave., South Milwaukee, Wis. 53172

[21] Appl. No.: 29,301

[22] Filed: Apr. 12, 1979

Related U.S. Application Data

[63] Continuation of Ser. No. 891,623, Mar. 30, 1978, abandoned.

[51] Int. Cl.[3] ..... E05C 5/02

[52] U.S. Cl. ..... 292/57; 49/67

[58] Field of Search ..... 292/57; 49/61, 667

[56] References Cited

U.S. PATENT DOCUMENTS

| | | | |
|---|---|---|---|
| 156,238 | 10/1874 | Squyer | 292/57 |
| 1,159,877 | 11/1915 | Smith | 292/57 |
| 2,845,789 | 8/1958 | Kistner | 292/57 X |
| 2,924,862 | 2/1960 | Pellicore | 49/67 X |
| 3,220,065 | 11/1965 | Graham | 49/67 |

*Primary Examiner*—J. Franklin Foss

*Attorney, Agent, or Firm*—Michael, Best & Friedrich

[57] ABSTRACT

The door latch includes a support bracket adapted to be mounted on the interior surface of an outer screen or storm door, an elongated bolt slidably and rotatably carried in a guideway on the support bracket, and a transversely extending handle on the bolt which extends through a slot in the guideway and is somewhat longer than the spacing between the outer door and an inner door. When the handle is in a generally horizontal operating position, the slot permits the bolt to slide freely between a latching position wherein the outer end is received in a keeper on the door frame and an unlatched position wherein the bolt is retracted from the keeper. Detent recesses located at the opposite ends of the slot permit the handle to be rotated downwardly to a generally vertical non-operating position when the bolt is in either the latching or unlatched positions and prevent sliding of the bolt unless the handle is rotated to the operating position. The handle cannot be rotated to the operating position for unlatching the bolt any time inner door is closed.

8 Claims, 3 Drawing Figures

DOOR LATCH

CROSS REFERENCE TO RELATED APPLICATION

This is a continuation of application Ser. No. 891,623, filed Mar. 30, 1978, now abandoned.

BACKGROUND OF THE INVENTION

The invention relates to latches and, more particularly, bolt latches for doors and the like.

Outer screen doors or storm doors for homes commonly are provided with some sort of inside locking mechanism which ordinarily can be easily forced open from the outside or conveniently unlatched from the outside after the glass or screen in the door has been broken through. Consequently, these locking mechanisms are not particularly effective as a deterent to a burglar and provide very little additional security.

Bolt type latches are widely used as inside door locks because of their simple operation, low cost and effectiveness. Such latches typically include a rod or bolt mounted on a support bracket for rotational and longitudinal movement by a knob or handle on the bolt. The support bracket usually includes a slotted guideway through which the handle projects and the guideway has detents which receive the handle and serve to prevent movement of the bolt from the latching position to unlatched position, and vice versa, unless the handle is rotated to a generally horizontal position. Exemplary prior art constructions for bolt latches are disclosed in U.S. Pat. Nos. 2,403,065 (Engert), issued July 2, 1946 and 2,543,171 (Jaden), issued Feb. 27, 1951.

Bolt latches are not particularly effective as inside locks for outer screen or storm doors because a burglar can open the outer door by simply breaking through the glass or screen in the vicinity of the latch, reach through the opening and rotate the handle to a horizontal or operating position, and slide the bolt to the unlatched position.

SUMMARY OF THE INVENTION

A principal object of the invention is to provide a latch for an outer screen or storm door and the like which, although simply constructed, cannot be unlatched from the outside as long as the inner door is closed.

Another object of the invention is to provide a modified bolt type latch which is particularly adaptable for use as an inside latch on an outer screen or storm door and the like.

Other objects, aspects and advantages of the invention will become apparent to those skilled in the art upon reviewing the following detailed description, the drawing and the appended claims.

The invention provides a door latch including a support bracket having a base adapted to be mounted on the interior of the door in a double door installation, an elongated bolt carried by the support bracket for relative rotational movement and relative slidable movement between a latching position wherein the outer end is received in a keeper and an unlatched position wherein the bolt is retracted from the keeper, and an elongated handle affixed on and extending transversely from the bolt for rotating the bolt and for moving the bolt between the latching and unlatched positions. The handle has a length greater than the spacing between the doors and the support bracket is provided with a guide arranged to permit reciprocal longitudinal movement of the bolt when the handle is located in a first or operating position extending transversely of the plane of the base and to prevent longitudinal movement of the bolt from the latching position to the unlatched position unless the handle is rotated to a second or non-operating position angularly displaced from the operating position. Thus, when the other door is closed, the handle engages the other door to prevent rotation thereof to the operating position, thereby preventing movement of the bolt from the latching position.

DESCRIPTION OF THE PREFERRED EMBODIMENTS

Figure 1:
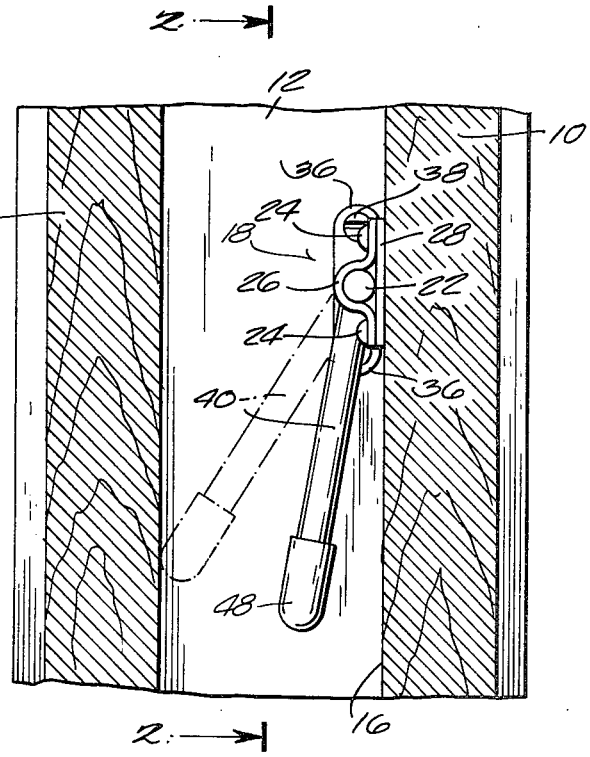
FIG. 1 is an end view of a door latch embodying the invention, shown mounted on the interior of an outer screen or storm door.

Illustrated in FIG. 1 is a home door installation including an outer screen or storm door 10 hinged on a door frame 12 for outward swinging movement from the position shown and an inner door 14 hinged on the door frame 12 for inward swinging movement from the position shown.

Mounted on the interior surface 16 of the outer door 10, between the outer and inner doors 10 and 14, is a latch 18 embodying the invention. The latch 18 includes a support bracket 20 and an elongated cylindrical rod or bolt 22 carried by the support bracket 20 for both rotational movement and slidable longitudinal movement relative to the support bracket 20. The support bracket 20 is suitably secured to the outer door 10 by threaded fasteners 24 or the like.

Figure 2:
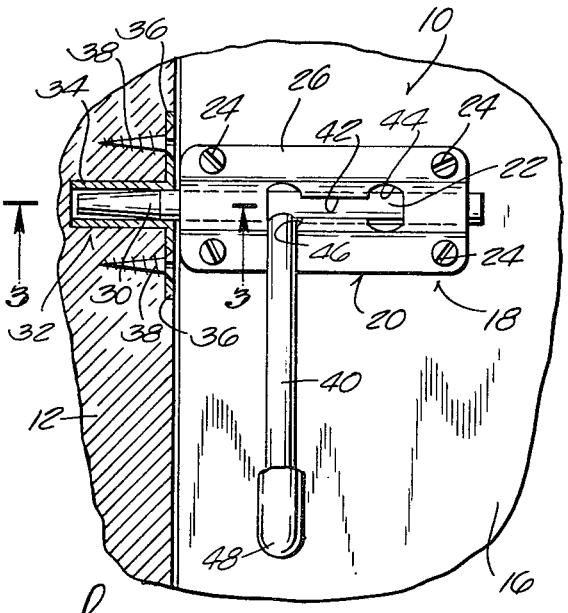
FIG. 2 is a front elevational view of the door latch taken generally along line 2—2 in FIG. 1.
Figure 3:
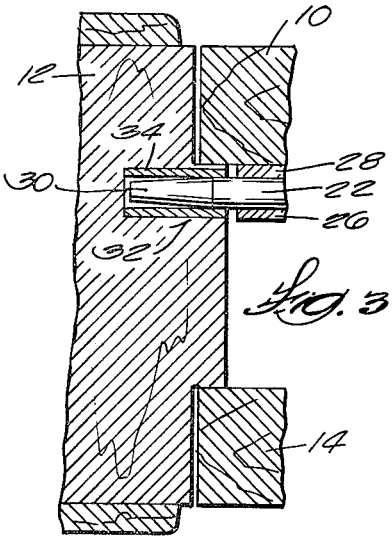
FIG. 3 is a fragmentary sectional view taken generally along line 3—3 in FIG. 2.

While various arrangements can be used, in a specific construction illustrated, the support bracket 20 includes a generally U-shaped strap 26 which has a raised central portion and is suitably secured, such as by spot welding or the like, to a base plate 28. Both the strap 26 and the base plate 28 can be conveniently stamped from a sheet metal. The raised central portion of the strap 26 cooperates with the base 28 to define a longitudinally extending channel or guideway slidably receiving the bolt 22 for reciprocal longitudinal movement between a latching position shown in FIG. 2 wherein the outer end 30 is received in a fixture or keeper 32 mounted on the door frame 12 and an unlatched position wherein the outer end 30 is retracted from the keeper 32 to permit the outer door 10 to be opened.

In the specific construction illustrated, the keeper 32 has a cylindrical sleeve 34 which is inserted to a hole drilled in the door frame 12 and a pair of diametrically opposed, laterally extending ears 36, each having an aperture for receiving a mounting screw 38. Other suitable keeper constructions can be used consistent with the specific door installation.

Affixed on and extending generally perpendicularly from the bolt 22 is an elongated, cylindrical handle 40 for moving the bolt 22 between the latching and unlatched positions. The handle 40 extends through a longitudinally extending slot 42 provided in the raised central portion of strap 26. The slot 42 has a width slightly larger than the outer diameter of the handle 40 and is located to permit reciprocal longitudinal movement of the bolt between the latching and unlatched positions when the handle 42 is swung or rotated to an operating position extending transversely of the plane of the base plate 28, e.g., extending generally horizontally or perpendicularly from the plane of the base plate 28.

Located at the opposite ends of the slot 42 is a respective recess 44 and 46, each of which extends circumferentially with respect to the bolt axis and receives the handle 40 to permit rotational movement thereof from the operating position to a non-operating position angularly displaced from the operating position. The recesses 44 and 46 serve as an abutment or detent means for preventing longitudinal movement of the bolt 22 unless the handle 40 is rotated to the operating position.

In the specific construction illustrated, the recesses 44 and 46 accommodate approximately 90° rotation of the handle 40 in opposite directions from the horizontal position. That is, the handle 40 is generally vertical or parallel to the plane of the base plate 28 when in the non-operating position as shown by the solid lines in FIG. 1. With this arrangement, the latch 18 can be mounted adjacent either the right edge or the left edge of the outer door 10 and the handle 40 can be rotated downwardly to the non-operating position when the bolt 22 is in the latching and unlatched positions.

The handle 40 has a length somewhat greater than the spacing between the inner and outer doors 10 and 14 so that it engages the inner door 14 as shown by the dashed lines in FIG. 1 when rotational movement from the non-operating position to the operating position is attempted with the inner door 14 closed. As a consequence, the handle 40 cannot be rotated to the operating position and the bolt 22 cannot be moved from the latching position to the unlatched position. Thus, even though a burglar might gain access to the latch handle 40 by breaking through the glass or screen in the outer door 10, he cannot move the bolt 22 to an unlatched position as long as the inner door 14 is closed. If the inner door 14 is locked, a burglar would have to force open the inner door before he can unlock the outer door 10. The additional time and effort required for such an operation tends to discourage unauthorized entries.

A cap 48 made from a plastic, elastomeric material or the like can be fitted over the outer end of the handle 40 to serve as a knob and also as a bumper to minimize scratching of the inner and outer doors. The bolt 22 and the handle 40 preferably are formed as a one-piece unit or the handle 40 is secured to the bolt 22, such as by welding, prior to assembly with the support bracket 20. In either case, the handle 40 is inserted through the slot 42, the bolt 22 slipped into the U-shaped channel defined by the raised central portion of the strap 26 and the base plate 28 thereafter secured to the strap 26. The outer end of the bolt 22 preferably is slightly tapered as illustrated to minimize binding with the keeper sleeve 34.

From the above description, it can be seen that the latch of the invention, while simply constructed, provides a positive deterent against forced opening of an outer door. While the latch has been described in conjunction with a door installation including an outwardly swinging outer door, it can also be used on either vertically sliding or laterally sliding outer doors. In the latter case, the latch can be mounted adjacent the top or bottom edge of the outer door with the bolt vertically oriented and the keeper can be located in the door frame transom or the door sill or threshold. Also, it can be appreciated that the latch can be conveniently adapted for use with other double door or window installations including an outer door or window and an inner door or window. Accordingly, the term "door installation" as used herein, broadly encompasses double door and double window installations and other similar installations.

While a preferred embodiment of the invention has been illustrated and described in detail, it should be understood that the invention is not limited thereby and various modifications and alterations can be made without departing from the spirit and scope of the invention.

I claim:

1. A latch for a door installation including first and second doors mounted in spaced, facing relationship and for movement relative to each other between open and closed positions, said latch comprising a support bracket including a base adapted to be mounted on the face of the first door between the first and second doors;

an elongated bolt having an outer end portion and carried by said support bracket for relative rotational movement and for relative slidable movement between a latching position wherein, when the first door is closed, said outer end portion is received in a keeper located adjacent the first door to prevent opening of the first door and an unlatched position wherein said outer end portion is retracted from the keeper to permit opening of the first door;

an elongated handle affixed on said bolt and extending transversely therefrom for rotating said bolt and for moving said bolt between the latching and unlatched positions, said handle having a length greater than the spacing between the first and second doors, and;

guide means on said support bracket for permitting reciprocal longitudinal movement of said bolt between the latching and unlatched positions when said handle is rotated to an operating position extending transversely of the plane of said base and generally perpendicular to the second door, said guide means including detent means for engageably receiving said handle and preventing longitudinal movement of said bolt from the latching position when said handle has been rotated to a non-operating position angularly displaced from the operating position whereby, during attempted rotational movement of said handle from a non-operating position to the operating position in a direction toward the second door with the second door closed, said handle engages the face of the second door to prevent movement of said handle to the operating position, thereby preventing movement of said bolt from the latching position.

2. A latch according to claim 1 wherein said support bracket includes a portion defining a longitudinally extending guideway receiving said bolt, and said guide means includes a longitudinally extending slot through which said handle extends.

3. A latch according to claim 2 wherein said slot is located such that said handle extends generally perpendicularly to the plane of said base when in the operating position.

4. A latch according to claim 2 or 3 wherein said detent means includes a pair of recesses in said portion corresponding to the latching and unlatched positions of said bolt, each of said recess opening into said slot and extending circumferentially with respect to the bolt axis for engagably receiving said handle and for permitting said handle to be rotated about the bolt axis to the non-operating position.

5. A latch according to claim 4 wherein each of said recesses is arranged to permit said handle to extend generally parallel to the plane of said base when rotated to the non-operating position.

6. A latch according to claim 5 wherein each of said recesses extends in opposite directions from said slot.

7. A latch according to claim 1 wherein said bolt and said handle is a one-piece unit.

8. A latch according to claim 1 including a cap of non-scratching material on the outer end of said handle.

* * * * *